US008418514B1

(12) United States Patent
Su

(10) Patent No.: US 8,418,514 B1
(45) Date of Patent: Apr. 16, 2013

(54) TABLET PROTECTOR

(75) Inventor: Jason Su, Changhua (TW)

(73) Assignee: Ingamar Co. Ltd., Changhua (TW)

( * ) Notice: Subject to any disclaimer, the term of this patent is extended or adjusted under 35 U.S.C. 154(b) by 0 days.

(21) Appl. No.: 13/310,781

(22) Filed: Dec. 4, 2011

(51) Int. Cl.
*E05B 69/00* (2006.01)

(52) U.S. Cl.
USPC ..... 70/58; 70/14; 70/57

(58) Field of Classification Search ..... 70/14, 15, 70/57, 57.1, 58
See application file for complete search history.

(56) References Cited

U.S. PATENT DOCUMENTS 5,836,183 A * 11/1998 Derman ..... 70/58
6,212,921 B1 * 4/2001 Knighton ..... 70/58
6,581,420 B1 * 6/2003 Ling et al. ..... 70/58
7,007,912 B1 * 3/2006 Giuliani et al. ..... 70/58
7,299,668 B1 * 11/2007 Lu ..... 70/58
7,611,119 B2 * 11/2009 Rossini ..... 70/58
7,724,520 B2 * 5/2010 Allen ..... 70/58
7,989,698 B2 * 8/2011 Guo et al. ..... 70/58
2004/0177658 A1 * 9/2004 Mitchell ..... 70/58
2011/0080137 A1 * 4/2011 Avganim ..... 70/58

* cited by examiner

*Primary Examiner* — Christopher Boswell
(74) *Attorney, Agent, or Firm* — Che-Yang Chen; Law Office of Michael Chen

(57) ABSTRACT

A tablet protector includes a main frame, a matching and a lock, wherein the main frame and matching frame are engaged with each other to protect the periphery of the tablet. The lock is provided to lock and further restrict the position of the main frame and matching frame as to the tablet. Also, the steel cable extends from the lock to lock the tablet at any predetermined location and prevents the tablet (along with the main frame and matching frame) from being stolen and provides a better anti-theft result.

7 Claims, 8 Drawing Sheets

TABLET PROTECTOR

FIELD OF THE INVENTION

The present invention relates to a protection frame, and more particularly to a tablet protection frame using a main frame and a matching frame to cover and protect the tablet, and a lock to secure the tablet. A steel cable extends from the lock can restrict the tablet to provide a better anti-theft result.

BACKGROUND OF THE INVENTION

Tablets are small, portable and not restricted to specific space when in use, so they create a trend to replace the desktop and the market demand of tablets increases significantly year by year. However, since the tablets are small and portable, it is disadvantageous that they are easy to be stolen. When different tablets are provided for consumers to test and compare, or during the time when the consumer is testing the tablet, the tablet can be easily stolen if the agent temporarily walks away or does not pay attention. Or if the tablet has extremely important data stored therein, the damage for the owner cannot be measured by merely the value of the tablet. So, there is a need for developing an anti-theft lock specifically for tablets.

SUMMARY OF THE INVENTION

The technical problem the present invention wants to solve is that since the tablets are small and portable, it is disadvantageous that they can be easily stolen. When different tablets are provided for consumers to test and compare, or during the time when the consumer is testing the tablet, the tablet can be easily stolen if the agent temporarily walks away or does not pay attention. Or if the tablet has extremely important data stored therein, the damage for the owner cannot be measured by merely the value of the tablet. So, there is a need for developing an anti-theft lock specifically for tablets.

The technical point to solve the problem mentioned above is to provide a tablet protector including a main frame, a matching frame and a lock, wherein the main frame has a frame border extended from a periphery thereof, and an inward and bended restricting protruding rib is located on top of the frame border and parallel with a bottom portion of the main frame, so that a receiving space is defined inside the main frame. One side of the main frame has an opening to insert the tablet and the opening is protruding and outwardly to form a ladder-shaped protruding end and a locking portion in the center thereof. The locking portion has a long through hole and two locking holes. The matching frame has a second frame border extended from a periphery thereof, a matching opening corresponding to the opening of the main frame, and an inwardly bended second restricting protruding rib located on top of the frame border. The matching opening has a recessed slot, and a second long through hole corresponding to the locking portion of the main frame is located at center of the recessed slot, and two second locking holes are located at both sides of the second long through hole for a locking element to insert through. The lock has a T-shaped locking end corresponding to the long through hole and second long through hole of the main frame and matching frame respectively to engage the lock to form a locking status.

Comparing with the conventional art, it is advantageous that the present invention uses the main frame and matching frame to engage and protect the periphery of the tablet and provides the lock to lock and further restrict the position of the main frame and matching frame as to the tablet. Also, the steel cable extends from the lock to lock the tablet at any predetermined location and prevents the tablet (along with the main frame and matching frame) from being stolen and provides a better anti-theft result.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
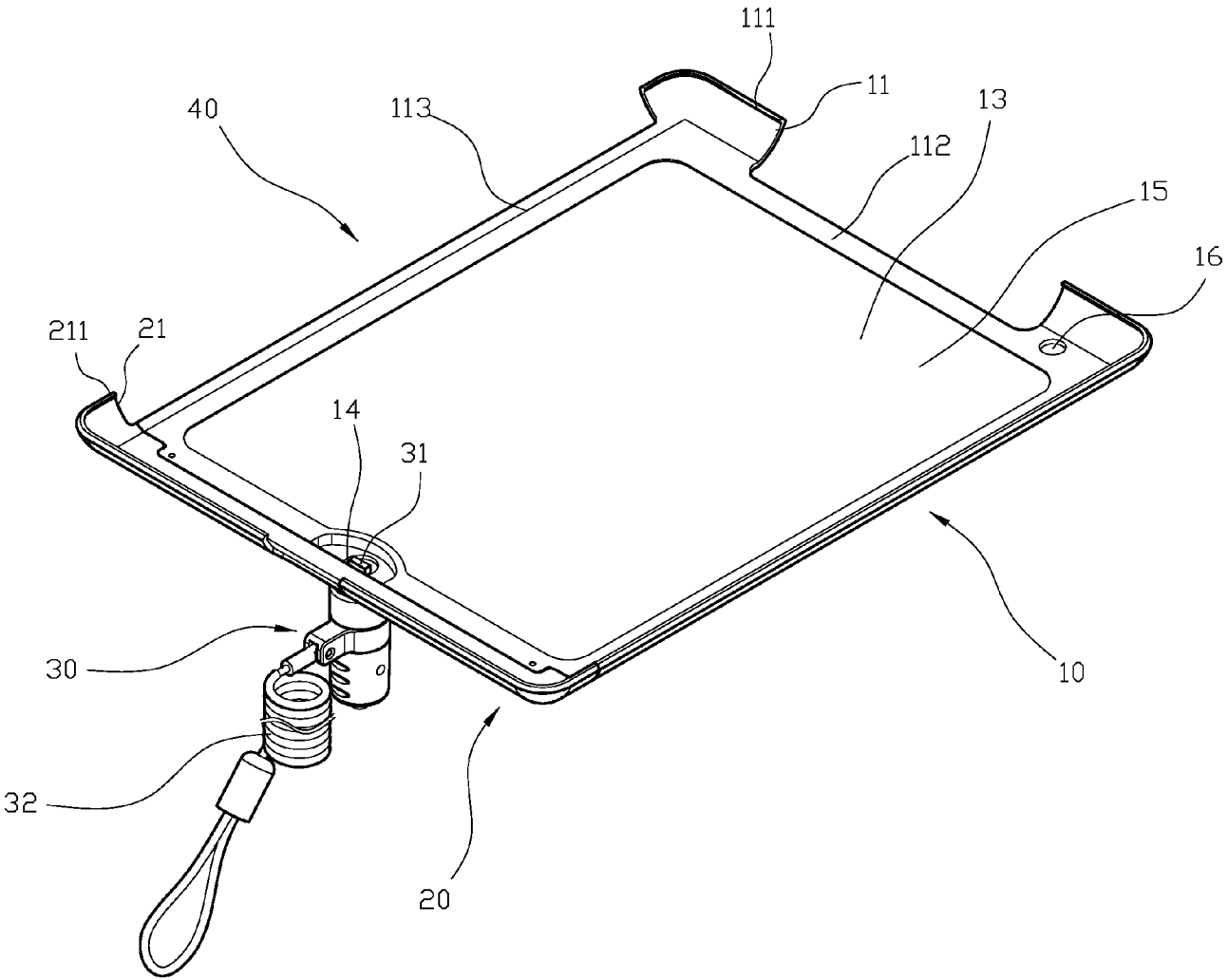
FIG. 1 illustrates a three-dimensional view in the present invention.
Figure 2:
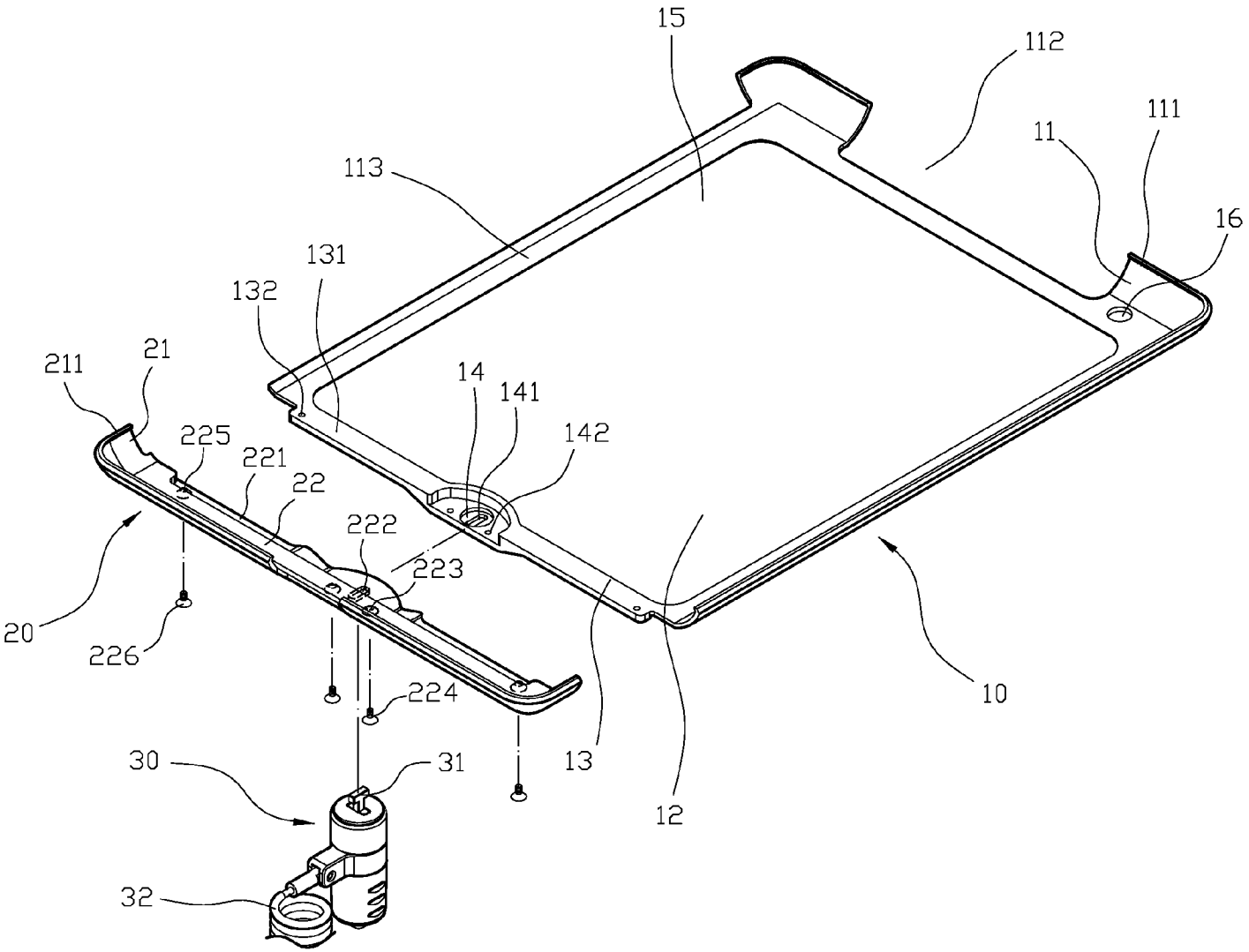
FIG. 2 illustrates an exploded view in the present invention.

In order to further understand the goal, characteristics and effect of the present invention, a number of embodiments along with the drawings are illustrated as following:

Referring to FIGS. 1 and 2, a tablet protector includes a main frame (10), a matching frame (20) and a lock (30). The main frame (10) has a frame border (11) extended from a periphery thereof, and an inward and bended restricting protruding rib (111) is located on top of the frame border (11) and parallel with a bottom portion of the main frame (10), so that a receiving space (12) is defined inside the main frame (10). The main frame (10) has an opening (13) to receive a tablet, and the opening (13) has a ladder-shaped protruding end (131) at a front end of the opening (13), and a locking portion (14) is located at a center portion thereof. The locking portion (14) has a long through hole (141) and two locking holes (142), and the main frame (10) has a connecting slot (112) located at the opening (13) of the (short) main frame (10) used to receive the tablet, and the (long) frame border (11) has an empty trough (113). A square opening (15) is through and formed at the bottom portion of the main frame (10), and a camera through hole (16) is formed at a corner of the bottom portion. The matching frame (20) has a second frame border (21) extended from a periphery thereof, a matching opening (22) corresponding to the opening (13) of the main frame (10), and an inwardly bended second restricting protruding rib (211) located on top of the frame border (21). The matching opening (22) has a recessed slot (221), and a second long through hole (222) corresponding to the locking portion (14) of the main frame (10) is located at center of the recessed slot (221), and two second locking holes (223) are located at both sides of the second long through hole (222) for a locking element (224) to insert through. The protruding end (131) of the main frame (10) A screw hole (132) is located on both sides of an outer portion of the protruding end (131) of the main frame (10), and a second screw hole (225) is located at an outer portion of the recessed slot (221) of the matching frame (20) with a second locking element (226). The lock (30) has a T-shaped locking end (31) corresponding to the long through hole (141) and the second long through hole (222) after the main frame (10) and the matching frame (20) engaged with each other, and the lock (30) is used at the locking portion (14) to form a locking status.

Figure 3:
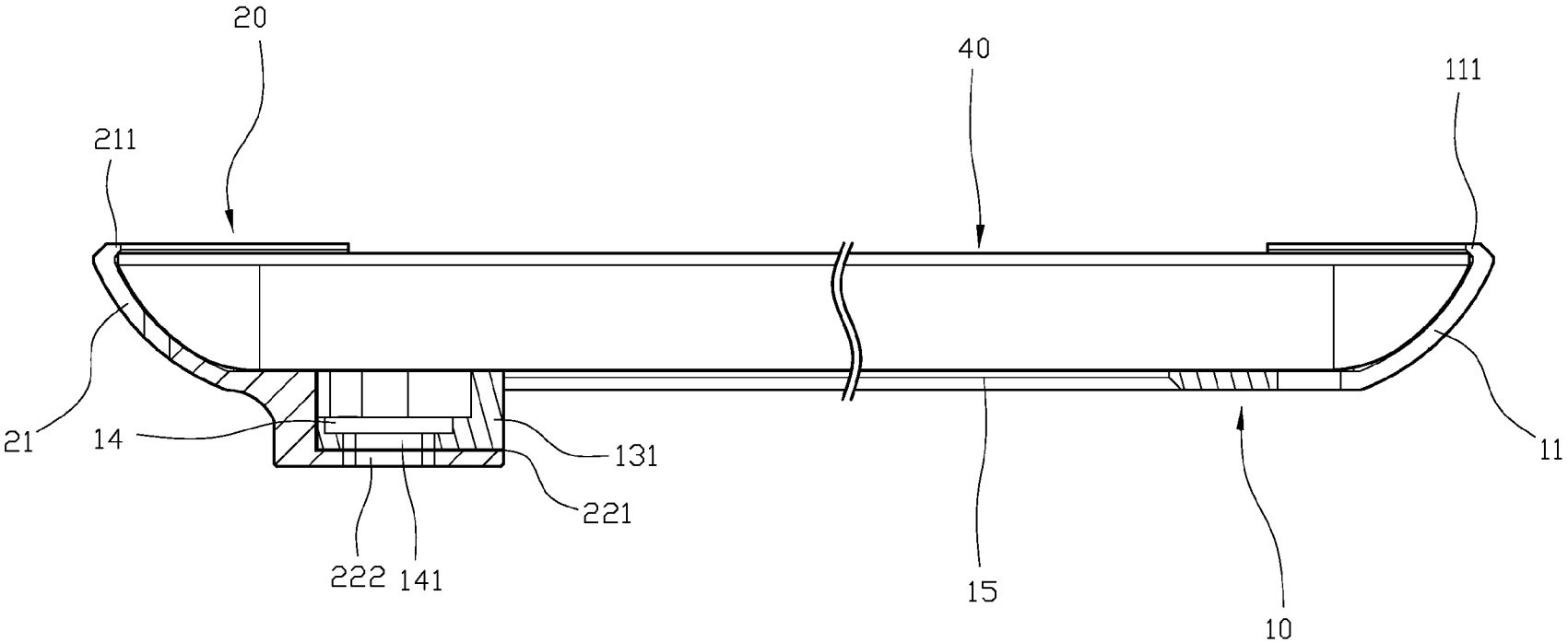
FIG. 3 illustrates a sectional view of the engagement of the main frame and the matching frame in the present invention.
Figure 4:
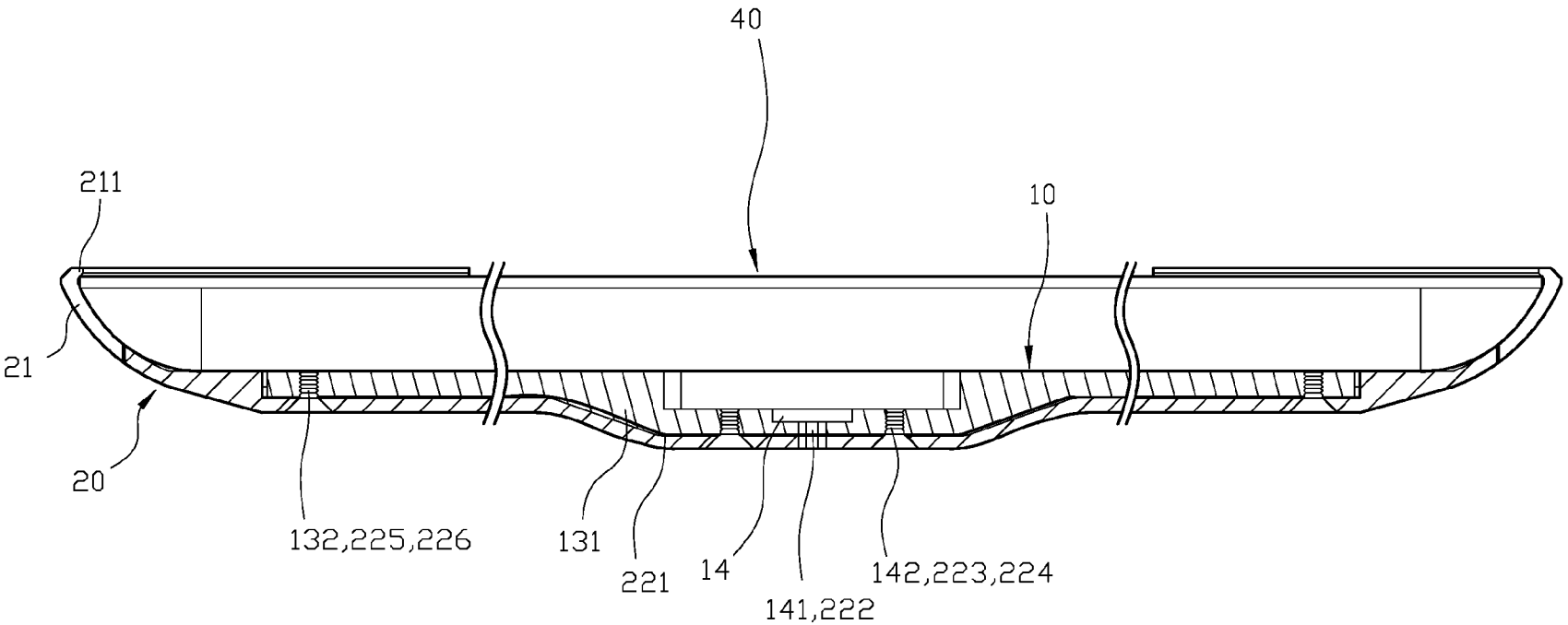
FIG. 4 illustrates a sectional view from another angle of the engagement of the main frame and the matching frame in the present invention.

As to practical usage referring to FIGS. 2, 3 and 4, a tablet (40) is inserted into the receiving space (12) from the opening (13) on the side of the main frame (10), and covered by the frame border (11) and the restricting protruding rib (111). Also, rear end of the tablet (40) extends out of the opening (13) after being inserted, and the matching frame (20) covers the rear end of the tablet (40) with the matching opening (22), and outer periphery of the tablet (40) is covered by the second frame border (21) and second restricting protruding rib (211). The matching opening (22) of the matching frame (20) engages with the protruding end (131) of the main frame (10) via the recessed slot (221), so that the long through hole (141), locking holes (142) and screw hole (132) of the main frame (10) are corresponding to the second long through hole (222), second locking holes (223) and second screw hole (225) of the matching frame (20), and the locking element (224) and second locking element (226) can screw to lock the second locking holes (223) and the locking holes (142), second screw hole (225) and the screw hole (132) to protect the tablet (40) with the engaged main frame (10) and matching frame (20).

Figure 5:
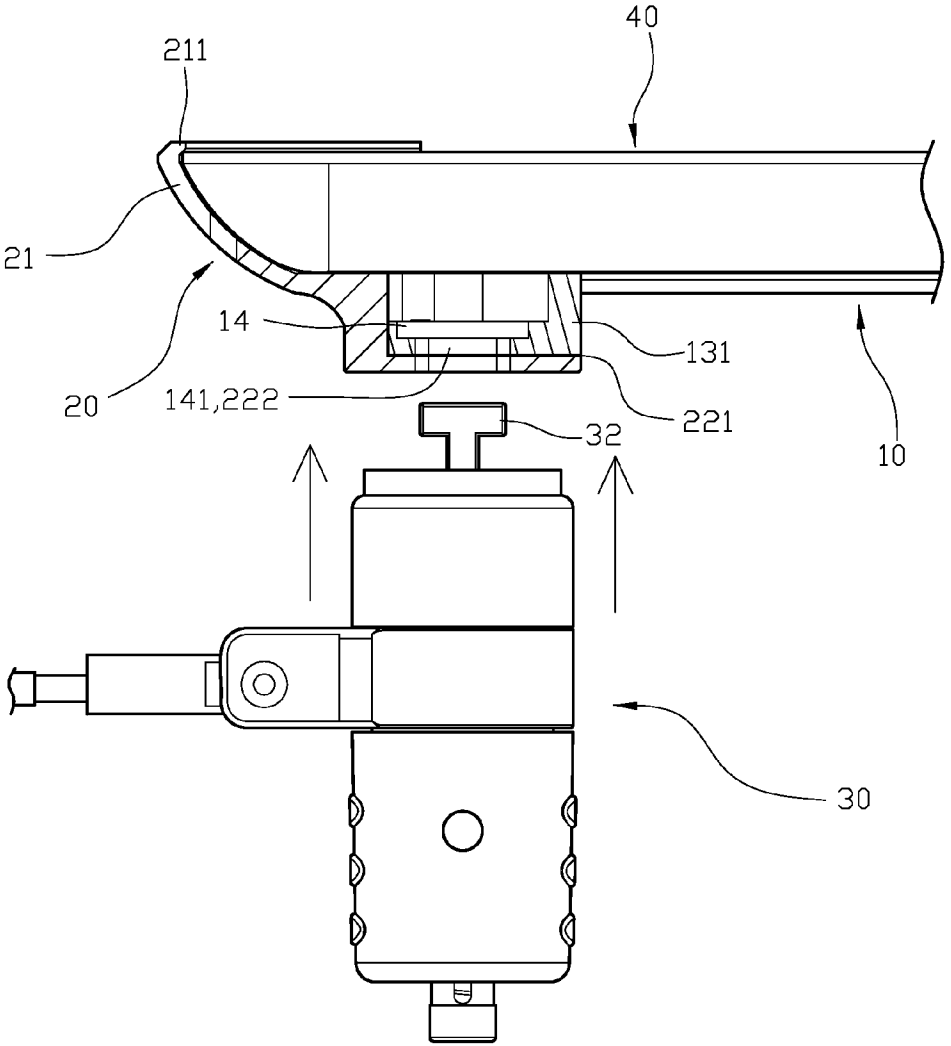
FIG. 5 illustrates a schematic view of the lock and engaged main frame and the matching frame in the present invention.
Figure 6:
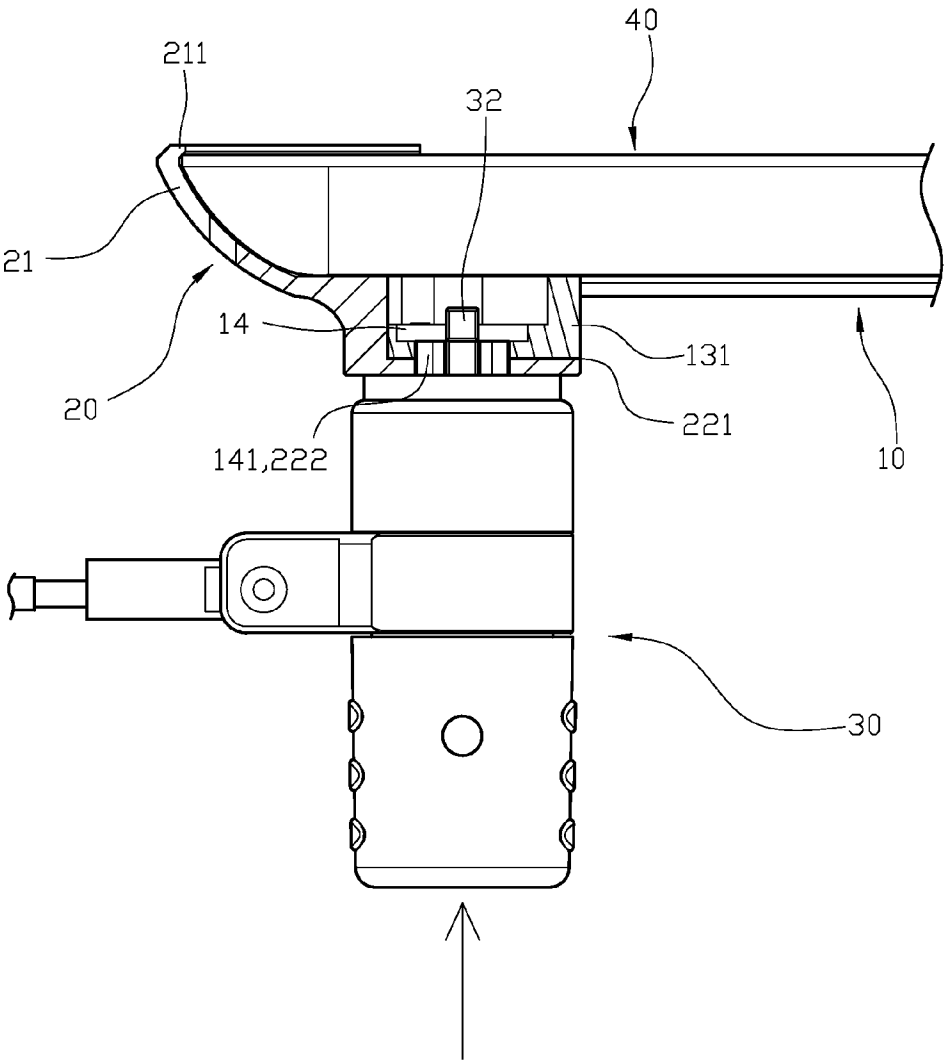
FIG. 6 illustrates a schematic view of the lock conjugating with engaged main frame and the matching frame in the present invention.
Figure 7:
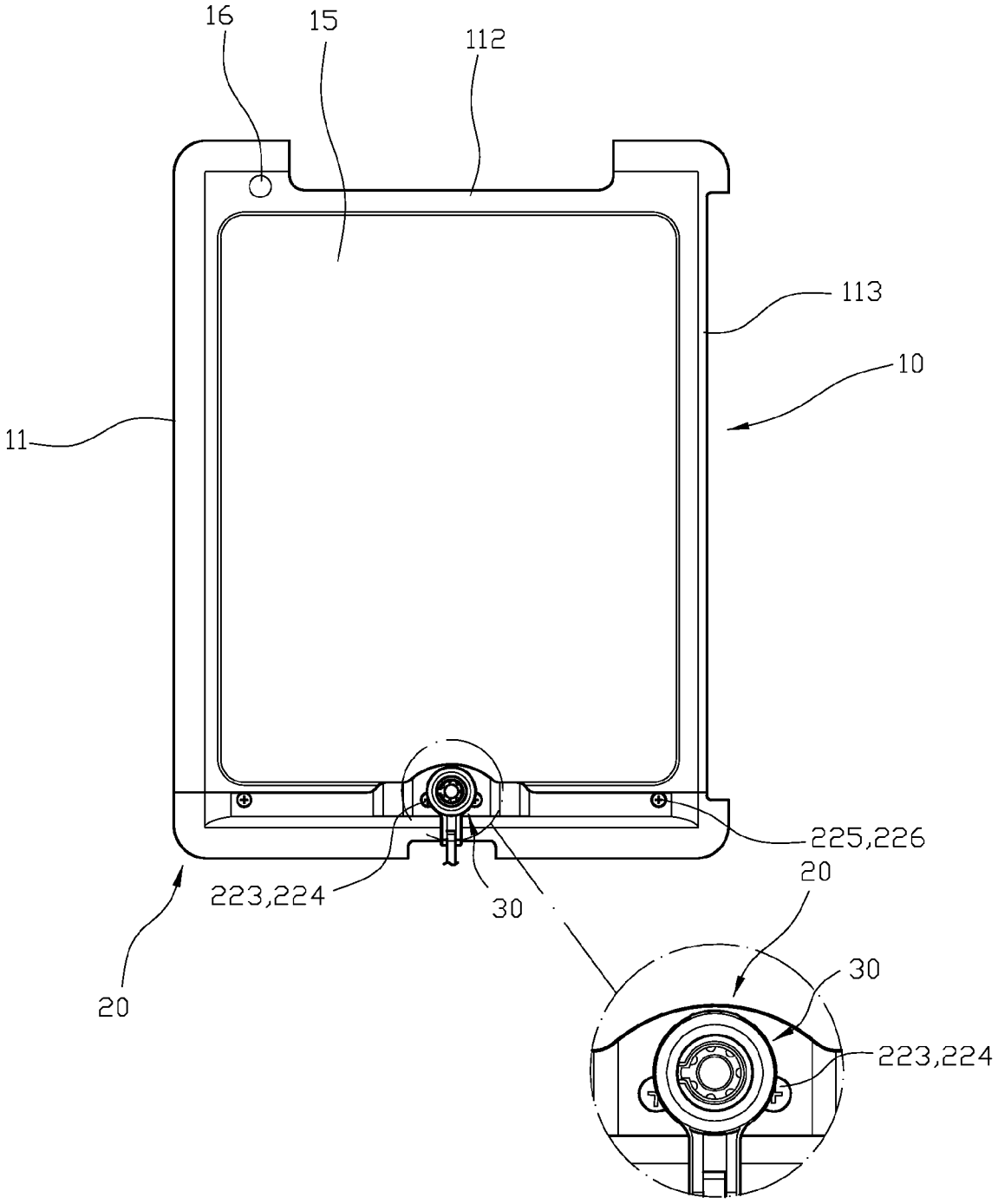
FIG. 7 illustrates a first schematic view of the lock (after conjugation) blocking the locking element at the bottom of the matching frame the present invention.
Figure 8:
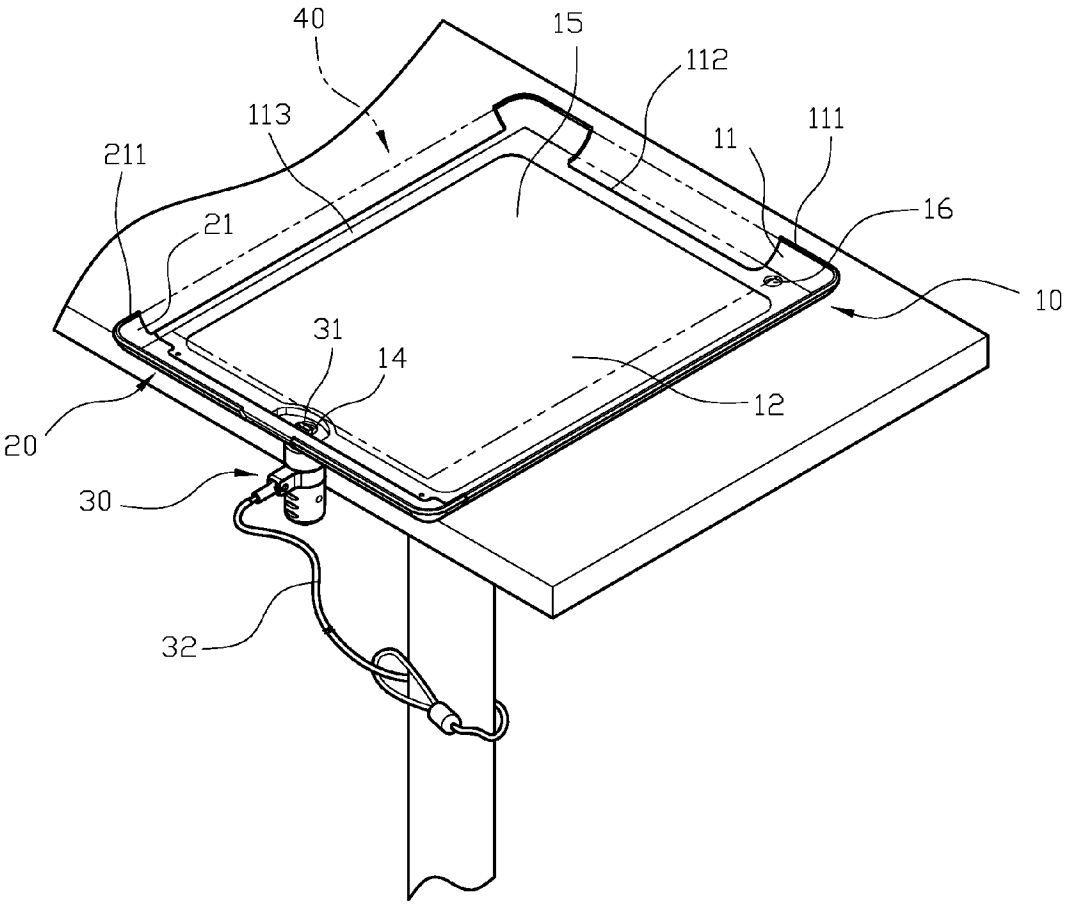
FIG. 8 illustrates the lock restricted at a predetermined location by a steel cable in the present invention.

Referring to FIGS. 5, 6 and 7, the T-shaped locking end (31) of the lock (30) passes through the long through hole (141) and the second through hole (222) of the main frame (10) and the matching frame (20), and forms the locking status at the locking portion (14). Also, when the lock (30) is secured, it blocks the second locking holes (223) with the locking element (224) at the bottom of the matching frame (20) to prevent the locking element (224) from being loosened. Also, a steel cable (32) extends from the lock (30) (see FIG. 8), which can be fixed at desk legs or any predetermined location to restrict the movement of the tablet (40) to prevent the tablet (40) being stolen and provide a better anti-theft result.

According to the embodiments disclosed above, it is advantageous that the present invention uses the main frame (10) and matching frame (20) to engage and protect the periphery of the tablet (40) and provides the lock (30) to lock and further restrict the position of the main frame (10) and matching frame (20) as to the tablet (40). Also, the steel cable (32) extends from the lock (30) to lock the tablet (40) at any predetermined location and prevents the tablet (40) (along with the main frame (10) and matching frame (20)) from being stolen and provides a better anti-theft result.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A tablet protector comprising:

a main frame having a frame border extended from a periphery thereof, and an inward and bended restricting protruding rib located on top of the frame border and parallel with a bottom portion of the main frame, so that a receiving space is defined inside the main frame, wherein one side of the main frame has an opening to insert a tablet, and the opening is protruding and outwardly to form a ladder-shaped protruding end and a locking portion formed at a center thereof, wherein the locking portion has a long through hole and two locking holes, a matching frame having a second frame border extended from a periphery thereof, a matching opening corresponding to the opening of the main frame, and an inwardly bended second restricting protruding rib located on top of the frame border, wherein the matching opening has a recessed slot, and a second long through hole corresponding to the locking portion of the main frame is located at center of the recessed slot, and two second locking holes are located at both sides of the second long through hole for a locking element to insert through; and a lock having a T-shaped locking end corresponding to the long through hole and second long through hole of the main frame and matching frame respectively to engage the lock to form a locking status, wherein the main frame and the matching frame surround periphery of the tablet to enclose the tablet therein.

2. The tablet protector of claim 1, wherein the main frame has a connecting slot located at the opening of main frame on a short frame border.

3. The tablet protector of claim 1, wherein the main frame has an empty trough located at the main frame on a long frame border.

4. The tablet protector of claim 1, wherein a square opening is through and formed at a bottom portion of the main frame.

5. The tablet protector of claim 1, wherein a connecting hole is formed at a corner of a bottom portion of the main frame.

6. The tablet protector of claim 1, wherein a screw hole is located on both sides of an outer portion of the protruding end of the main frame, and a second screw hole is located at an outer portion of the recessed slot of the matching frame.

7. The tablet protector of claim 1, wherein a steel cable is extended from the lock.

* * * * *